United States Patent [19]

Zaffrann et al.

[11] 3,992,601

[45] Nov. 16, 1976

[54] COVER FOR DISCONNECT SWITCH

[75] Inventors: Albert A. Zaffrann; Grant W. Nelson, both Milwaukee, Wis.

[73] Assignee: Allen-Bradley Company, Milwaukee, Wis.

[22] Filed: Apr. 7, 1975

[21] Appl. No.: 565,382

[52] U.S. Cl. ..... 200/295

[51] Int. Cl.[2] ..... H01H 9/02

[58] Field of Search ..... 200/293, 295–296, 200/48 R

[56] References Cited

UNITED STATES PATENTS

| | | | |
|---|---|---|---|
| 3,243,564 | 3/1966 | Burch | 200/295 |
| 3,369,099 | 2/1968 | Norden et al. | 200/293 |
| 3,412,225 | 11/1968 | Rogers et al. | 200/295 |

*Primary Examiner*—Herman J. Hohauser

*Attorney, Agent, or Firm*—Quarles & Brady

[57] ABSTRACT

A molded plastic cover fastens to the front of a disconnect switch and encloses elements of each switch pole. The cover includes a cap section which is hinged to swing downward and allow access to the input line terminals of the switch, and it includes a panel section which is hinged to swing downward and allow access to the switch contacts and modular arc chutes.

8 Claims, 9 Drawing Figures

COVER FOR DISCONNECT SWITCH

BACKGROUND OF THE INVENTION

The field of the invention is disconnect switches, and more particularly, manually operated disconnect switches having a set of movable contact blades which are carried by a crossbar and pivoted between an opened and closed position by a manually operated trip mechanism.

In a disconnect switch such as that disclosed in copending U.S. patent application Ser. No. 516,388 entitled "Disconnect Switch, " each pole of the three-pole switch is enclosed within its own separate compartment formed by an integrally molded base. Each pole includes a stationary contact which connects to an input line terminal, a movable contact which is mounted to a rotatable crossbar, and an output line terminal which electrically connects to the movable contact. Each pole also includes a modular arc chute which is slidably received in a mating cavity formed within each compartment and positioned directly over the contacts to extinguish any arcs which are generated when the switch is opened. The elements of each pole are accessible from the front of the compartment.

Disconnect switches are often employed with other electrical components to form control circuits, and in such applications, auxiliary contacts are mounted to the switch base for operation by the crossbar. In the above cited copending patent application, for example, the auxiliary contacts are contained in cartridges which are inserted in auxiliary chambers located between the pole compartments. The wire terminals on each cartridge are accessible from the front of the disconnect switch.

SUMMARY OF THE INVENTION

The present invention relates to a cover for the front of a disconnect switch, and more particularly, to a cover which fastens to the disconnect switch base and encloses selected pole elements in each of its compartments. The cover includes a mounting section which is firmly fastened to the switch base and a panel section which is hinged to the mounting section and movable between a substantially horizontal maintenance position and an upright operating position in which it releasably fastens to the switch base and encloses the selected pole elements in each compartment.

A general object of the invention is to substantially enclose the arc chutes, stationary contacts and movable contacts of each pole and to facilitate inspection and replacement of these elements. Windows are formed in the panel section of the cover and they are aligned in front of the archways of each arc chute to allow visual inspection of the movable contacts which are disposed therein. If the movable contacts or arc chutes are to be inspected further, or replaced, the panel section may be unfastened from the base and swung to its maintenance position in which unobstructed access to these elements is provided.

Another object of the invention is to allow access to the input line terminals when the disconnect switch is to be wired in place. A cap section is hinged to the panel section of the cover and is movable between an upright operating position and a substantially horizontal wiring position in which the input line terminals of the disconnect switch are exposed. When the wiring is completed the cap section is swung to its upright operating position in which it effectively covers the input line terminals.

Yet another object of the invention is to facilitate the mounting and wiring of auxiliary contact cartridges. Auxiliary openings are formed in the cover and auxiliary contact cartridges may be inserted or removed from their auxiliary chambers through these openings. A wire channel is formed along the front surface of the mounting section of the cover to confine and direct the wires which connect to the auxiliary contact cartridges to either side of the switch.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

DESCRIPTION OF THE PREFERRED EMBODIMENT

Figure 1:
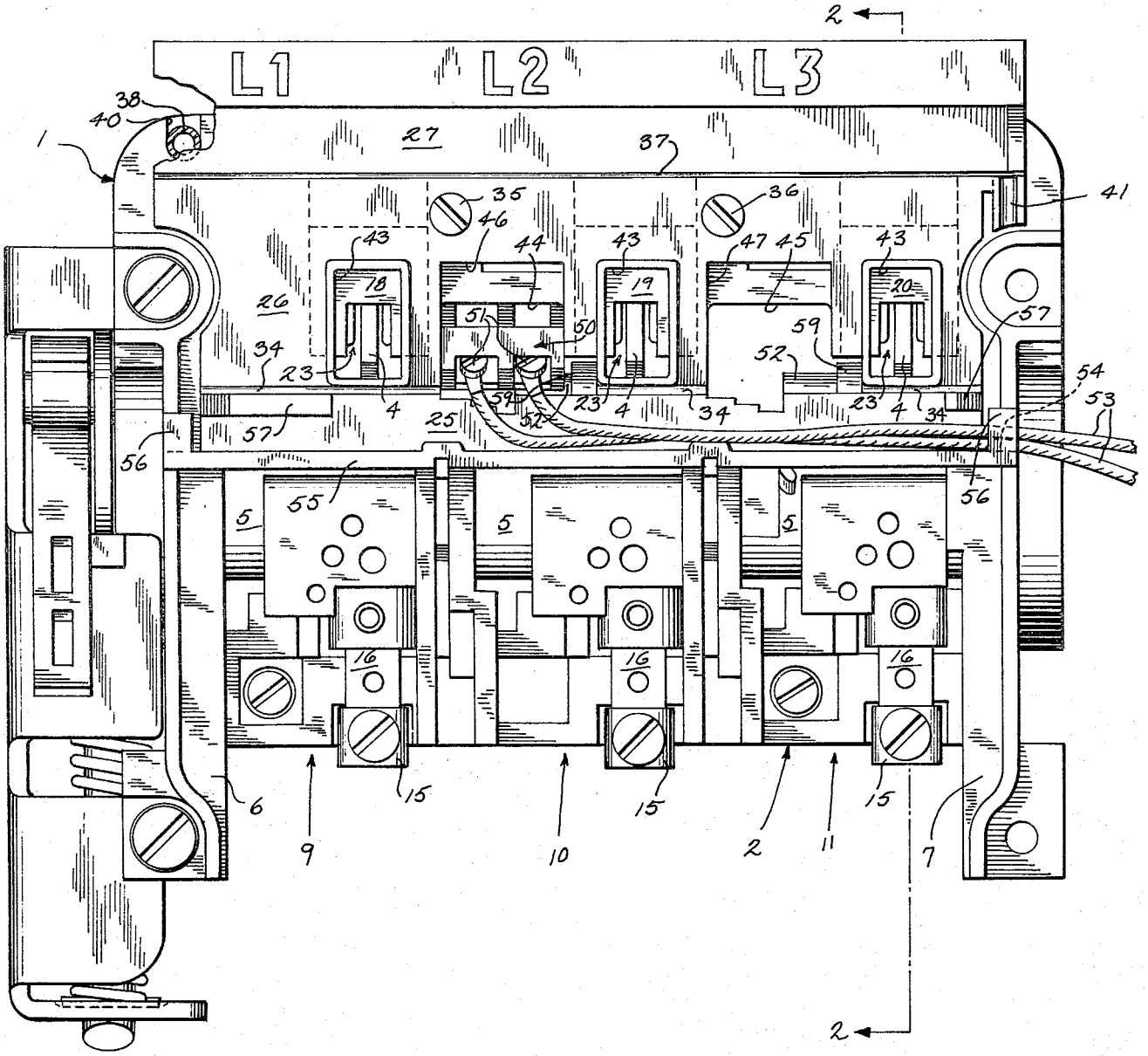
FIG. 1 is a front elevation view of a disconnect switch which incorporates the cover of the present invention.
Figure 2:
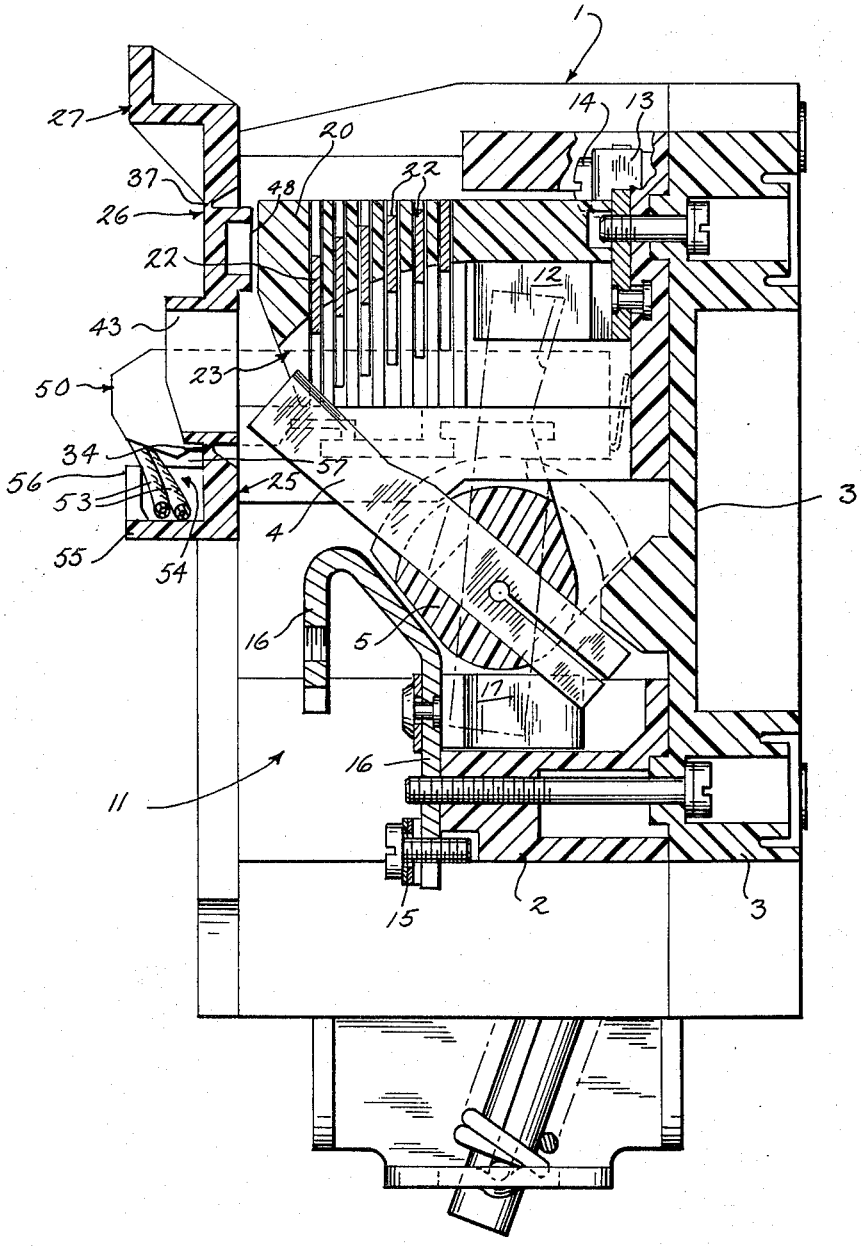
FIG. 2 is a view in cross section taken along the plane indicated by the line 2—2 in FIG. 1.

Referring particularly to FIGS. 1 and 2, the disconnect switch includes a two-part housing 1 which is formed by a base 2 and back 3 which are molded from an electrically insulating thermoset phenolic material and fastened together by a set of screws (not shown in the drawings). The housing 1 rotatably supports a crossbar 5 which is journaled to a pair of spaced side walls 6 and 7 and which runs transversely through the interior of the housing 1 along a horizontal actuator axis. The housing 1 encloses a three-pole, sngle throw disconnect switch and is divided into three compartments 9, 10 and 11 which each enclose the elements of one pole.

The three poles are identical, and each includes a movable contact blade 4 which is fastened to the crossbar 5 and which is pivoted thereby about the actuator axis between an opened and closed position. When in its closed position, each movable contact blade 4 makes electrical connection with an associated stationary contact 12. The stationary contacts 12 in turn make electrical connection with input line terminals 13 which mount to the base 2, are positioned within the compartments 9, 10 and 11 and are disposed across the top of the base 2. Terminal screws 14 on the input line terminals 13 are directed forward and are accessible from the front of the disconnect switch.

Also disposed within the compartments 9, 10 and 11 and associated with each of the movable contact blades 4 is an output line terminal 15. The line terminals 15 connect to a metal strap 16 which mounts to the base 2 and which fastens to a connector 17 that makes slidng electrical connecton with the lower end of the movable contact blade 4. The output line terminals 15 are disposed across the bottom edge of the base 2 and are positioned to face forward in each compartment 9, 10 and 11. For a more detailed description of the disconnect switch elements, reference is made to the above cited copending patent application.

Figure 5:
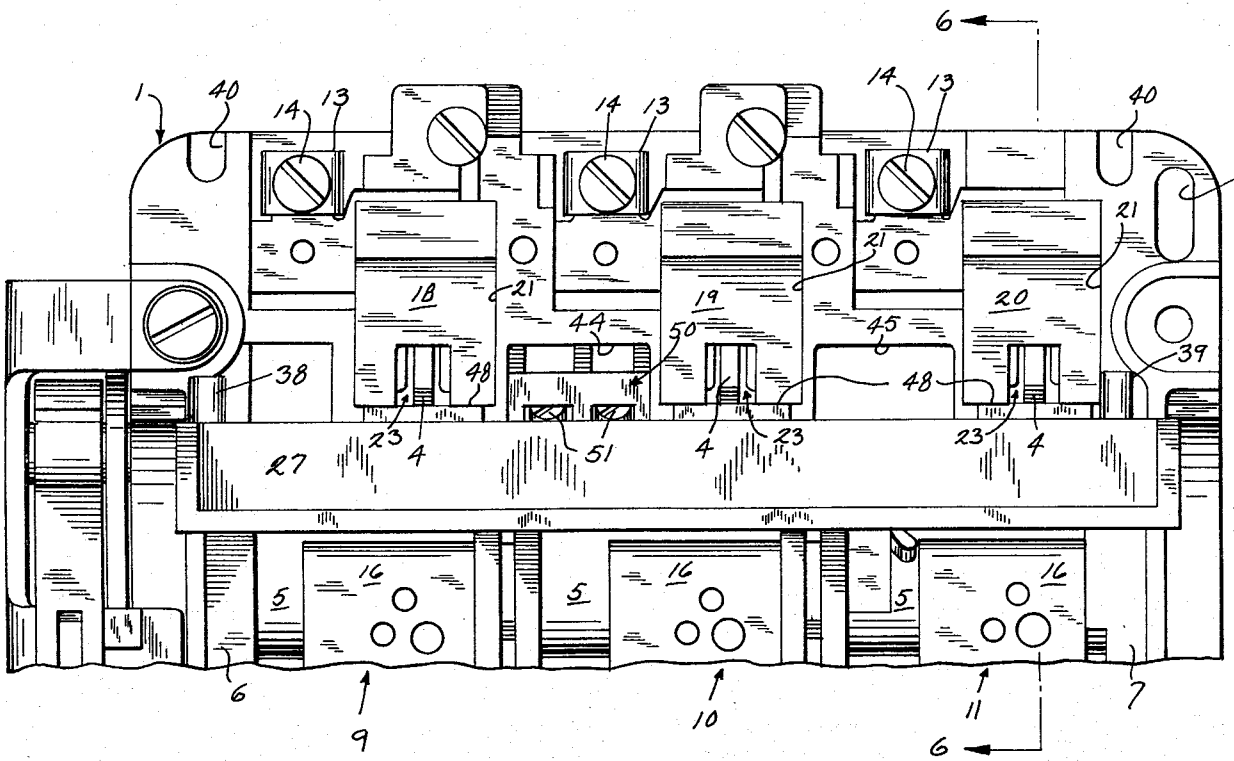
FIG. 5 is a partial front elevation view of the disconnect switch and cover of FIG. 1 showing the panel section of the cover swung to its maintenance position.

Referring particularly to FIGS. 2 and 5, modular arc chutes 18, 19 and 20 are slidably received in the respective compartments 9, 10 and 11 and are positioned immediately above the movable contact blades 4. Each modular arc chute is received in a rectangular cavity 21 formed in the base 2 within each compartment 9, 10 and 11, and each modular arc chute 18, 19 and 20 may be removed from the disconnect switch for inspection or repair by pulling it forward. As described in more detail in the above cited copendng patent application, each modular arc chute 18, 19 and 20 includes a set of deionization plates 22 that form an archway 23 through which the upper end of a movable contact blade 4 swings when the disconnect switch is operated between its opened and closed positions.

Referring particularly to FIGS. 1 and 2, the cover of the present invention is mounted to the front of the base 2 and extends substantially across its entire width. The cover is molded from a single piece of electrically insulating, flame retarding, injection molding grade polypropylene, such as FR1060 commercially available from Allied Chemical Corporation. It includes a substantially rectangular shaped mounting section 25, a substantially rectangular shaped panel section 26, and a substantially rectangular shaped cap section 27.

Figure 7:
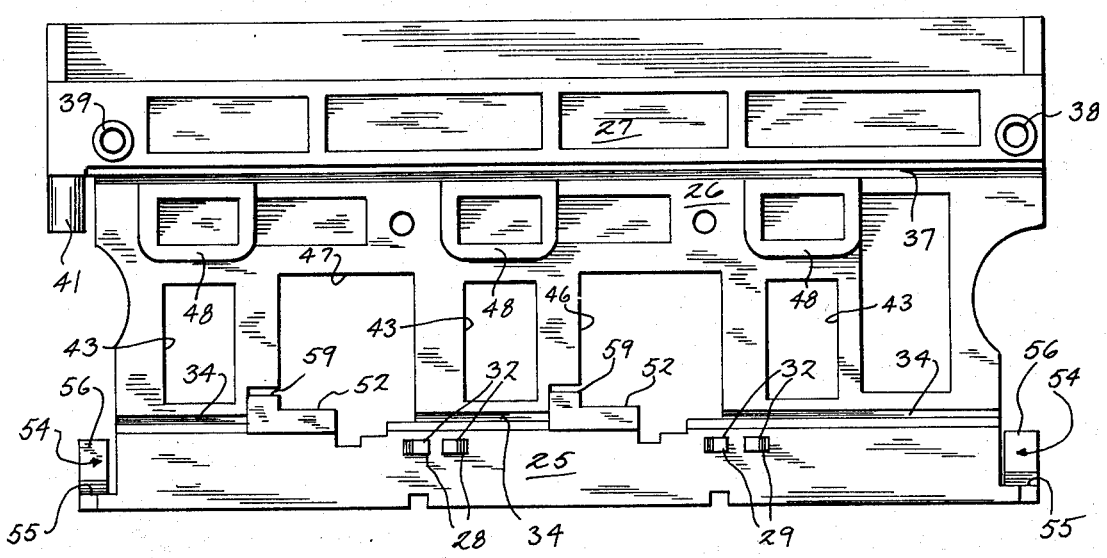
FIG. 7 is a rear elevation view of the cover.
Figure 8:
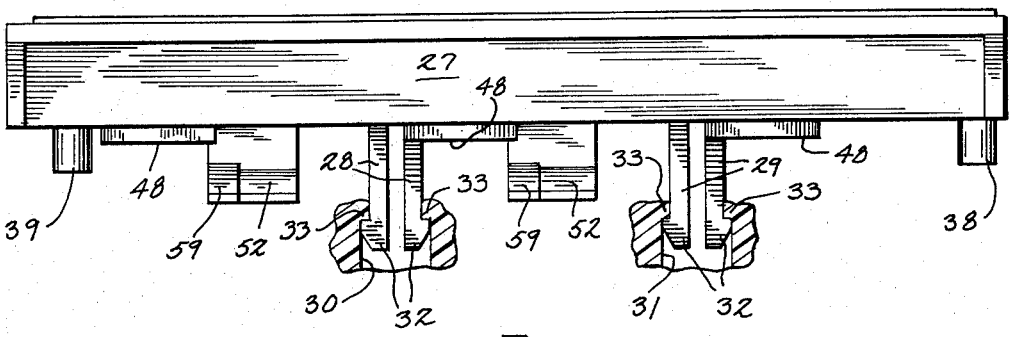
FIG. 8 is a top view of the cover.
Figure 9:
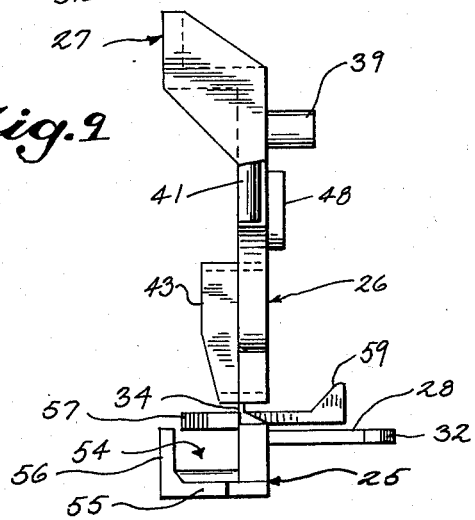
FIG. 9 is a side elevation view of the cover.

As shown in FIGS. 7 and 8, the mounting section 25 of the cover includes two sets of prongs 28 and 29 which are integrally molded to its back surface and which extend rearward into openings 30 and 31 formed in the base 2. Each of the prongs 28 and 29 includes a hook member 32 on its end which engages the back surface of a lip 33 formed on each side of the openings 30 and 31. The cover is securely fastened to the base 2 by inserting the prongs 28 and 29 into the respective openings 30 and 31. The prongs 28 and 29 flex laterally outward to lock the mounting section 25 in place against the front surface of the base 2. The mounting section 25 extends across the front of the disconnect switch between its side walls 6 and 7 and covers a portion of each compartment 9, 10 and 11 immediately beneath the auxiliary chambers.

Figure 6:
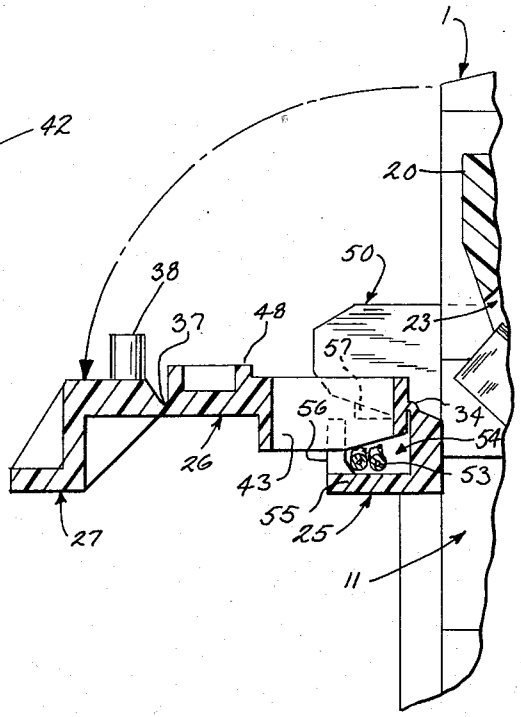
FIG. 6 is a partial view in cross section taken along the plane indicated by the line 6—6 in FIG. 5.

Referring particularly to FIGS. 1, 2, 5 and 6, the panel section 26 of the cover is connected to the mounting section 25 by a flexible hinge 34 which extends horizontally across the width of the cover. The hinge 34 is formed by a constriction, or necking, in the molded cover, and the molded material is sufficiently flexible to allow the panel section 26 and attached cap section 27 to be pivoted between a substantially horizontal maintenance position, as shown in FIGS. 5 and 6, and an upright operating position, as shown in FIGS. 1 and 2. The panel section 26 is releasably fastened to the base 2 by a pair of captive screws 35 and 36 which are received in threaded inserts, secured in the base 2.

Figure 4:
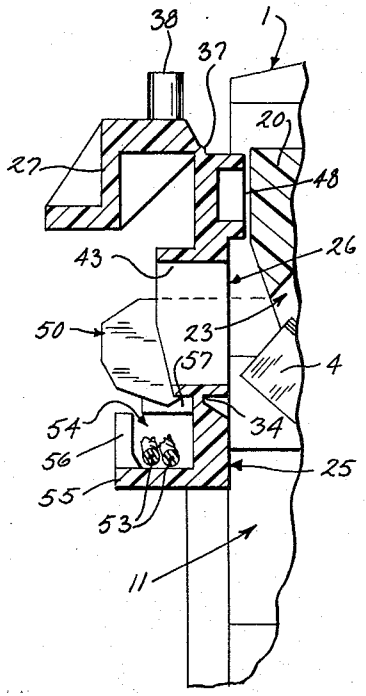
FIG. 4 is a partial view in cross section taken along the plane indicated by the line 4—4 in FIG. 3.
Figure 3:
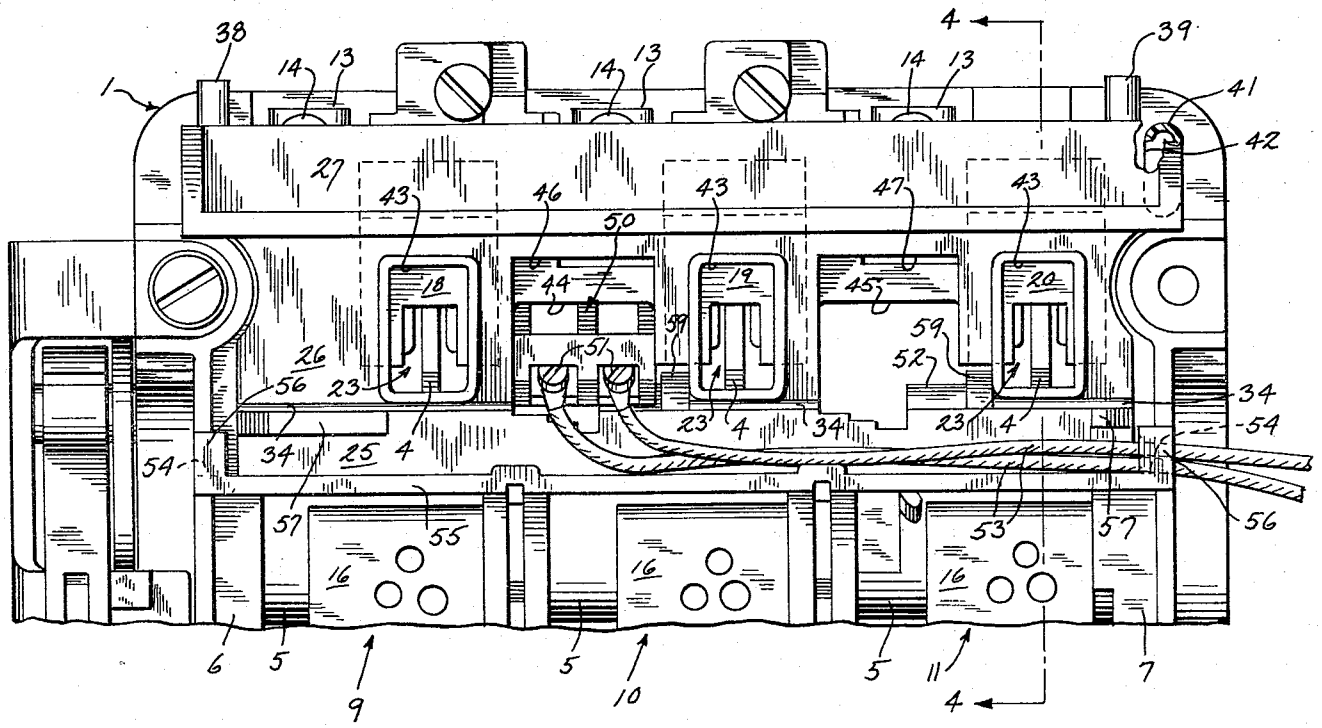
FIG. 3 is a partial front elevation view of the switch and cover of FIG. 1 with the cap section of the cover swung to its wiring position.

The cap section 27 is similarly attached to the panel section 26 by a hinge 37 which is formed by a constriction in the molded cover that extends horizontally across its entire width. The cap section 27 is movable between a substantially horizontal wiring position, as shown in FIGS. 3 and 4, and an upright operating position, as shown in FIGS. 1 and 2. The cap section 27 is releasably retained in its upright operating position by a pair of integrally molded retainer sleeves 38 and 39 which extend rearward from its back surface adjacent each of its ends. The sleeves 38 and 39 are compliant and when the cap section 27 is moved to its operating position, the sleeves 38 and 39 are received and locked in chanels 40 which are formed in the base 2. A third retainer half sleeve 41 is also integrally formed to the cap section 27 and it extends downward from the right hand end of the cover. The third retainer half sleeve 41 is received in a channel 42 which is formed in the base 2, and when the cap section 27 is pivoted downward to its wiring position as shown in FIG. 3, the third retainer half sleeve 41 swings rearward and upward into tight engagement with the channel 42. The cap section 27 is thus releasably retained in the wiring position.

The cover of the present invention allows easy access to the elements of the disconnect switch. The cap section 27 is disposed directly in front of the input line terminals 13, and by pivoting the cap section 27 to its horizontal wiring position, the input line terminals 13 and their associated terminal screws 14 are readily accessible for the attachment or disconnection of the power lines which lead to the disconnect switch. Similarly, the panel section 26 is positioned directly in front of the modular arc chutes 18, 19 and 20 and by pivotng it to its horizontal maintenance position, access is gained to the modular arc chutes 18, 19 and 20, movable contact blades 4 and stationary contacts 12.

Rectangular stop members 48 are formed on the back side of the cover and these are positioned to bear against the forward ends of the arc chutes 18, 19 and 20 when the panel section 26 is fastened in its upright operating position. The modular arc chutes 18, 19 and 20 are thus not only enclosed by the cover, but are also tightly retained within their respective cavities 21 by the panel section 26 of the cover. To facilitate examination of the movable contact blades 4 and the modular arc chutes 18, 19 and 20, a set of three rectangular windows 43 are formed through the panel section 26 and are aligned directly in front of the archways 23 of each modular arc chute 18, 19 and 20. The position of the movable contact blades 4 may thus be readily seen and the condition of the blades 4 and deionization plates 22 may be examined without lowering the panel section 26 to its maintenance position.

As disclosed in more detail in the above cited copending patent application, a pair of auxiliary chambers 44 and 45 are formed in the base 2 between the three disconnect switch poles. These chambers 44 and 45 extend from a structural floor which is contiguous with the back 3 forward to the front surface of the base 2. An auxiliary contact cartridge 50 may be coupled to the disconnect switch crossbar 5 by inserting it into the auxiliary chambers 44 or 45. Each auxiliary contact cartridge 50 includes one or more sets of electrical contacts which are fully enclosed in a plastic case and which are operated by a cam member (not shown in the drawings) which is responsive to the rotation of the crossbar 5. Wire terminals 51 are disposed on the forward end of each auxiliary contact cartridge 50, and these terminals 51 extend forward from the front of the base 2. For a more detailed description of the auxiliary contact cartridges reference is made to copendng U.S. patent application Ser. No. 487,975 entitled "Auxiliary Switch for Electro-Magnetic Contactor."

A pair of rectangular auxiliary openings 46 and 47 are formed in the panel section 26 and are aligned directly in front of the auxiliary chambers 44 and 45. A pair of locking mechanisms 52 are integrally formed on the back surface of the cover and are aligned beneath the auxiliary openings 46 and 47. The locking mechanism 52 is depressed downward when an auxiliary contact carttridge 50 is inserted through its associated opening 46 or 47 and it snaps upward into locking engagement with the cartridge 50 when the cartridge 50 is fully inserted. As shown best in FIGS. 1 and 8, a release portion 59 is formed on each locking mechanism 52 and is easily accessible from the front through the associated auxiliary opening 46 or 47. An auxiliary contact cartridge 50 may be removed by depressing the release portion 59 of the locking mechanism 52 with a screw driver or other similar tool and then pulling the cartridge 50 forward through the opening 46 or 47. For a more detailed description of the manner in which the auxiliary contact cartridges 50 are mounted to the disconnect switch, reference is made to the above cited copending application Ser. No. 516,388.

Referring particularly to FIGS. 1 and 2, an auxiliary contact cartridge 50 is connected to wires 53 which lead to control circuitry (not shown in the drawings) which is associated with the disconnect switch. The wires 53 connect to the wire terminals 51 on the cartridge 50 and they extend horizontally along a wire channel 54 which is formed on the mounting section 25 of the cover. More specifically, the wire channel 54 includes a ledge portion 55 which extends forward from the lower edge of the mounting section 25 along its entire width and two integrally formed upright side portions 56 which are disposed at the left hand and right hand ends of the channel 54. Two forwardly extending retainer walls 57 are also integrally formed to the mounting section 25 of the cover and are positioned at the left hand and right hand ends of the wire channel 54 to confine the wires 53 in their run from the auxiliary contact cartridge 50 to either side of the disconnect switch. The wire channel 54 is disposed below the panel section 26 of the cover, and as a result, the wires 53 need not be disconnected from the auxiliary contact cartridge 50 when the panel section 26 is unfastened and pivoted downward to its maintenance position.

A cover has thus been described which encloses the operating elements of a disconnect switch and which facilitates connection of the disconnect switch, inspection of its operating elements and maintenance of these elements. The cover also provides convenient means for labeling the switch elements, and particularly, the line terminals.

I claim:

1. In a disconnect switch having a base which defines compartments that house the elements of each switch pole, the improvement therein of a cover which comprises:

a mounting section that securely fastens to the front of said switch base and extends substantially across the entire lateral extent of said base;

hinge means connected to and disposed along a top edge of said mounting section;

a panel section connected to said hinge means for pivotal motion between a maintenance position and a substantially upright operating position in which it encloses selected pole elements in each of said compartments; and means for releasably fastening said panel section to said base when said panel section is in its operating position.

2. The cover as recited in claim 1 which includes second hinge means connected to and disposed along a top edge of said panel section and a cap section which connects to said second hinge means for pivotal motion between a wiring position and a substantially upright operating position in which it encloses other selected pole elements in each of said compartments.

3. The cover as recited in claim 2 in which said mounting section, panel section, cap section and first and second hinge means are molded from a single piece of plastic material.

4. The cover as recited in claim 2 in which said cap section is releasably retained in its upright operating position by a compliant retainer sleeve which extends rearward from the back surface of said cap section and is received in a mating locking channel which is formed in said switch base.

5. The cover as recited in claim 1 in which windows are formed in said panel section and are aligned directly in front of said selected pole elements to allow visual inspection thereof when said panel section is in its operating position.

6. The cover as recited in claim 1 in which an opening is formed in said mounting section through which an auxiliary contact cartridge may be inserted for attachment to the disconnect switch, and a wire channel is formed on the front of said mounting section and extends substantially across its lateral extent to guide and confine wires which connect to said auxiliary contact cartridges.

7. The cover as recited in claim 6 in which a locking mechanism is integrally formed to the mounting section adjacent said opening for engaging and retaining an auxiliary contact cartridge inserted therein, said locking mechanism including a release portion which is accessable from the front of said cover through said opening.

8. The cover as recited in claim 1 in which said mounting section and said panel section are molded from a single piece of plastic material and said hinge means is formed by a constriction in the piece of plastic material which extends substantially horizontally across the lateral extent of the cover.

* * * * *